United States Patent [19]

Feldman

[11] Patent Number: 4,755,189

[45] Date of Patent: Jul. 5, 1988

[54] MIDDLE DISTILLATE FUEL HAVING IMPROVED LOW TEMPERATURE FLOW PROPERTIES

[75] Inventor: Nicholas Feldman, Woodbridge, N.J.

[73] Assignee: Exxon Research and Engineering Company, Florham Park, N.J.

[21] Appl. No.: 680,976

[22] Filed: Dec. 12, 1984

[51] Int. Cl.[4] ..... C10L 1/14

[52] U.S. Cl. ..... 44/62; 44/70

[58] Field of Search ..... 44/62, 70

[56] References Cited

U.S. PATENT DOCUMENTS

| | | | |
|---|---|---|---|
| 3,790,359 | 2/1974 | Feldman | 44/62 |
| 3,846,093 | 11/1974 | Feldman | 44/62 |
| 3,955,940 | 5/1976 | Hollyday, Jr. | 44/62 |
| 3,981,850 | 9/1976 | Wisotsky et al. | 44/62 |
| 3,999,960 | 12/1976 | Langer, Jr. et al. | 44/62 |

FOREIGN PATENT DOCUMENTS

| | | | |
|---|---|---|---|
| 3328739 | 8/1983 | Fed. Rep. of Germany | 33/4 |

*Primary Examiner*—William R. Dixon, Jr.
*Assistant Examiner*—Margaret B. Medley
*Attorney, Agent, or Firm*—Edward H. Mazer; John W. Ditsler

[57] ABSTRACT

A wax-containing petroleum distillate fuel composition having improved low temperature flow properties is described. The distillate fuel has added thereto:

A. an amorphous, normally solid, essentially saturated hydrocarbon fraction substantially free of normal paraffin hydrocarbons;

B. a wax modifying random copolymer of ethylene and an unsaturated ester; and

C. an ether.

10 Claims, No Drawings

MIDDLE DISTILLATE FUEL HAVING IMPROVED LOW TEMPERATURE FLOW PROPERTIES

BACKGROUND OF THE INVENTION

This invention is related to wax-containing petroleum distillate having improved low temperature flow properties. More specifically, the present invention is related to a wax-containing middle distillate fuel oil having a boiling range within the limits of about 120° and about 400° C.

The problem of improving the cold flow properties of wax-containing distillates has become more pronounced recently because of increases in the demand for certain petroleum products, including kerosene and the middle distillates. Kerosene, which acts as a solvent for n-paraffin wax, normally had been a component of middle distillate fuel oils. The increased demand for kerosene in jet fuels has reduced the amount of kerosene available for use in middle distillate fuel oils. In addition, the increased demand for middle distillate fuel oils, particularly diesel fuel, while demand for gasoline has remained essentially flat, has made it attractive to maximize the production of middle distillates.

The wax present in middle distillates precipitates at low temperature, forming large waxy crystals which tend to plug the small pore openings of fuel filters. This problem is particularly acute for diesel fuels, where the openings in the fuel filter typically are between about 5.0 and about 50 microns. Conventional pour depressants, which lower the pour point, i.e., the point at which the fuel can no longer be poured, may not be completely satisfactory for preventing pluggage of the fuel filters. While pour depressants often prevent the fuel from setting up as a gel, large wax crystals may be formed. However, to improve the cold flow properties of wax-containing middle distillate fuels oils so that the wax does not plug the fuel filter pores, it is necessary that fine wax crystals be formed.

Considerable work has been directed at additives which improve the cold flow properties of the wax-containing middle distillate fuels. U.S. Pat. No. 3,790,359 is directed at the addition of from about 0.1 to about 3 weight percent of an essentially saturated hydrocarbon fraction substantially free of normal paraffinic hydrocarbons having a number average molecular weight in the range of about 600 to about 3,000, in combination with a copolymer of ethylene and an unsaturated ester, where the copolymer has less than 6 methyl terminating side branches per 100 methylene groups. The weight ratio of the saturated hydrocarbon fraction to the copolymer was disclosed to range between about 25:1 to about 1:1.

U.S. Pat. No. 3,999,960 discloses the use of ethers, particularly alkyldiphenylether, to improve the cold flow properties of wax-containing middle distillate fuels.

However, the continuing increase in diesel fuel may require the use of middle distillates having still greater n-paraffin wax contents. Frequently these fuels having high wax appearance points (WAP) do not respond well even to combinations, such as those previously noted.

Accordingly, it is desirable to provide an additive combination which is effective in improving the cold flow properties of middle distillate fuels having relatively high WAP values.

It is also desirable to provide a process in which the additive combination can be used in a relatively low concentration.

It would also be advantageous to utilize an additive combination which is relatively inexpensive.

It also would be advantageous to employ an additive combination which did not adversely affect the combustion properties of the fuel.

The present invention is directed at a wax-containing middle distillate fuel oil having added thereto to improve the low temperature flow properties the combination of:

(a) an amorphous, normally solid, essentially saturated hydrocarbon substantially free of paraffins;

(b) a copolymer of ethylene and an unsaturated ester; and (c) an ether.

SUMMARY OF THE INVENTION

The present invention is directed at a wax-containing middle distillate fuel having a boiling range within the limits of about 120° l C. and about 400° C. which has improved low temperature flow properties by the addition thereto of:

(a) an amorphous normally solid, essentially saturated hydrocarbon fraction substantially free of normal paraffin hydrocarbons;

(b) a wax modifying random copolymer of ethylene and an unsaturated ester; and (c) an ether.

The saturated hydrocarbon fraction preferably has a number average molecular weight of from about 600 to 3,000. The random copolymer preferably has a number average molecular weight of from about 1,000 to about 50,000 and has from about 3 to about 40 molar proportions of ethylene per molar proportion of other monomers. The copolymer preferably has less than 6 methyl-terminating side branches on the polyethylene backbone per 100 methylene groups in the backbone.

The unsaturated ester preferably has the general formula:

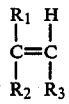

where:

$R_1$ is hydrogen or methyl;

$R_2$ is a —$OOCR_4$ or —$COOR_4$ group or a $C_1$–$C_{16}$, preferably a $C_1$–$C_4$ straight or branched chain alkyl group;

$R_3$ is hydrogen or —$COOR_4$; and $R_4$ is hydrogen or a $C_1$–$C_{28}$ straight or branched chain alkyl group, more usually a $C_1$–$C_{16}$ straight or branched chain alkyl group.

The ether preferably comprises an alkylated diphenylether alkylated with the dimer of an alpha olefin selected from the group consisting of $C_{32}$, $C_{34}$, $C_{36}$, $C_{38}$, $C_{40}$ and $C_{44}$ dimers.

The additive composition preferably comprises from about 0.05 weight percent to about 2.0 weight percent of the fuel, preferably between about 0.15 weight percent and about 0.75 weight percent.

The middle distillate fuel additive preferably has the following composition:

| Composition | Weight Percent |
|---|---|
| Amorphous Wax | 60–90 |
| Ethylene/Ester Copolymer | 15–30 |
| Ether | 5–20 |

DETAILED DESCRIPTION OF THE INVENTION

The present invention is directed at the combination of:

(a) an amorphous, normally solid, essentially saturated hydrocarbon fraction substantially free of normal paraffin hydrocarbons;

(b) a wax modifying random copolymer of ethylene and an unsaturated ester; and (c) an ether for improving the cold flow properties of a wax-containing middle distillate fuel.

The preparation and composition of each of these compounds is set forth below.

A. amorphous normally solid fraction—The fractions of essentially saturated hydrocarbons that are used in accordance with the present invention are generally amorphous solid materials having melting points within the range of about 27° C. to 60° C. and having number average molecular weights within the range of about 500 to about 3,000. This molecular weight range is above the highest molecular weight of any hydrocarbons that are naturally present in the fuel oil.

An amorphous hydrocarbon fraction that is useful in accordance with this invention can be obtained by deasphalting a residual petroleum fraction and then adding a solvent such as propane to the deasphalted residuum, lowering the temperature of the solvent-diluted residuum, and recovering the desired solid or semi-solid amorphous material by precipitation of a low temperature followed by filtration. The residual oil fractions from which the desired hydrocarbons are obtained will have viscosities of at least 125 SUS at 99° C. Most of these residual oils are commonly referred to as bright stocks.

In some instances products obtained by this procedure will be naturally low in normal paraffin hydrocarbons and can be used in the present invention without further treatment. For example, by low temperature propane treatment of a deasphalted residual oil from certain Texas coastal crude, a precipitated high molecular weight amorphous fraction can be obtained which has only a trace of normal paraffins, about 5 percent of isoparaffins, about 73 percent of cycloparaffins and about 22 percent of aromatic hydrocarbons. In other instances it is necessary to treat the high molecular weight fraction in some manner to reduce its content of normal paraffins. Removal of normal paraffins from an amorphous hydrocarbon mixture can be effected by complexing with urea. Solvent extraction procedures can also be used, but in many instances they are not as effective as complexing techniques. Thus, the amorphous hydrocarbon mixture can be dissolved in a ketone, e.g., methyl ethyl ketone, at its boiling point and then, when the solution is cooled to room temperature, the normal paraffins predominantly will be precipitated and the resultant supernatant solution will give a mixture containing some normal paraffins but predominating in cycloparaffins and isoparaffins.

Vacuum distillation can also be used for the removal of normal paraffin hydrocarbons from a high molecular weight paraffinic fraction, but such a procedure requires a very high vacuum, i.e., less than 5 mm Hg. absolute pressure, preferably a pressure below 3 mm Hg. absolute, e.g., 2 mm or 120 microns. If the pressure used is 5 mm or higher, the necessary temperature for the distillation is high enough to cause cracking of the constituents which is undesirable.

B. Copolymer—The copolymer flow improving additive that is used in this invention is a copolymer formed from about 3 to about 40 molar proportions of ethylene, and one mole of at least one second unsaturated monomer. The polymer is oil-soluble and is characterized by having less than six methyl terminating side branches on the polyethylene backbone per 100 methylene groups of the said backbone. Such polymers may be prepared by free radical catalysis in a solvent at temperatures of less than 130° C. in order to minimize ethylene branching, preferably using free radical catalysts or initiators that have a half-life of no greater than about one hour. The polymers have number average molecular weights in the range of about 1,000 to 50,000, preferably 1,000 to 6,000, more preferably about 1,000 to about 3,000, and more preferably about 1,500 to 2,500 as measured by Vapor Phase Osmometry, for example, by using a Mechrolab Vapor Phase Osmometer Model 310A. The preparation of this type of copolymer is taught in U.S. Pat. No. 3,981,850 of Max J. Wisotsky and Norman Tunkel, the disclosure of which is incorporated herein by reference. Other techniques may be used to make the copolymer, such as high temperature, high pressure continuous polymerization in a tubular reactor.

The unsaturated monomers, copolymerizable with ethylene, include unsaturated mono- and diesters of the general formula:

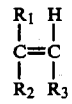

wherein $R_1$ is hydrogen or methyl, $R_2$ is a —$OOCR_4$ or —$COOR_4$ group wherein $R_4$ is hydrogen or a $C_1$ to $C_{28}$, preferably a $C_1$ to $C_{16}$ straight or branched chain alkyl group, and $R_3$ is hydrogen or —$COOR_4$. The monomer, when $R_1$ and $R_3$ are hydrogen and $R_2$ is —$OOCR_4$ includes vinyl alcohol esters of $C_2$ to $C_{17}$ monocarboxylic acids, preferably $C_2$ to $C_5$ monocarboxylic acids. Examples of such esters include vinyl acetate, vinyl isobutyrate, vinyl laurate, vinyl myristate, vinyl palmitate, etc. When $R_2$ is —$COOR_4$ such esters include methylacrylate, methyl methacrylate, laurylacrylate, palmityl alcohol ester of alpha-methyl-acrylic acid, $C_{13}$ oxo alcohol esters of methacrylic acid, etc. Examples of monomers where $R_1$ is hydrogen and $R_2$ and $R_3$ are —$COOR_4$ groups include mono- and diesters of unsaturated dicarboxylic acids such as mono-$C_{13}$ oxo fumarate, di-$C_{13}$ oxo fumarate, diisopropyl maleate, di-laurylfumarate, ethylmethyl fumarate, etc.

The oxo alcohols used in preparing the esters mentioned above are isomeric mixtures of branched chain aliphatic primary alcohols prepared form olefins, such as polymers and copolymers of $C_3$ to $C_4$ monoolefins, reacted with carbon monoxide and hydrogen in the presence of a cobalt-containing catalyst such as cobalt carbonyl, at temperatures of about 150° C. to 205° C., under pressures of about 1000 to 3000 psi, to form aldehydes. The resulting aldehyde product is then hydrogenated to form the oxo alcohol, the latter being recovered by distillation from the hydrogenated product.

As previously mentioned, about 3 to 40 moles of ethylene will be used per mole of other monomer, which other monomer is preferably an ester as hereinbefore defined, or a mixture of about 30 to 99 mole percent ester and 70 to 1 mole percent of a $C_3$ to $C_{16}$, preferably $C_4$ to $C_{14}$ branched or straight chain alpha monolefin. Examples of such olefins include propylene, n-octene-1, n-decene-1, etc.

In general, the polymerization can be carried out as follows. Solvent and a portion of the unsaturated ester, e.g., 0–50, preferably 10 to 30 weight percent, of the total amount of unsaturated ester used in the batch, are charged to a stainless steel pressure vessel which is equipped with a stirrer. The temperature of the pressure vessel is then brought to the desired reaction temperature with ethylene. Then catalyst, preferably dissolved in solvent so that it can be pumped, and additional amounts of unsaturated ester are added to the vessel continuously, or at least periodically, during the reaction time, which continuous addition gives a more homogeneous copolymer product as compared to adding all the unsaturated ester at the beginning of the reaction. Also during this reaction time, as ethylene is consumed in the polymerization reaction, additional ethylene is supplied through a pressure controlling regulator so as to maintain the desired reaction pressure fairly constant at all times. Following the completion of the reaction, the liquid phase in the pressure vessel is distilled to remove the solvent and other volatile constituents of the reacted mixture, leaving the polymer as a residue.

Usually, based upon 100 parts by weight of copolymer to be produced, about 100 to 600 parts by weight of solvent, and about 1 to 20 parts by weight of catalyst or initiator will be used.

The solvent can be any non-reactive organic solvent for furnishing a liquid phase reaction which will not poison the catalyst or otherwise interfere with the reaction, and preferably is a hydrocarbon solvent such as benzene, hexane, cyclohexane, dioxane, or tert-butyl alcohol.

The temperature used during the reaction will be in the range of 70° to 130° C., preferably 80° to 125° C. Preferred free radical catalysts or initiators are those which decompose rather rapidly at the prior noted reaction temperatures, for example, those that have a half-life of about an hour or less at 130° C., preferably. In general, this will include the acyl peroxides of $C_2$ to $C_{1-}$ branched or unbranched, carboxylic acids such as di-acetyl peroxide (half-life of 1.1 hours at 85° C.), dipropionyl peroxide (half-life of 0.7 hour at 85° C.), dipelargonyl peroxide (half-life of 0.215 hour at 80° C.), di-lauroyl peroxide (half-life of 0.1 hour at 100° C.), etc. The lower peroxides such as di-acetyl and dipropionyl peroxide are less preferred because they are shock sensitive, and as a result the higher peroxides such as di-lauryl peroxide are especially preferred. The short half-life catalysts also include various azo free radical initiators such as azobisobutyronitrile (half life, 0.12 hour at 100° C.), azo bis-2-methylheptonitrile and azo bis-2-methyl valeronitrile. In contrast to the preceding, di-tert butyl peroxide, which has been used extensively in the prior art, has a half-life of about 180 hours at 100° C. and a half-life of about 7 hours at 130° C., and does not produce the desired low degree of branching. For example, nuclear magnetic resonance studies indicate that a copolymer of 6 to 6.5 moles of ethylene per mole of vinyl acetate has an average of about 1.5 methyl-terminating side branches on the polyethylene backbone per 100 methylene groups of the backbone of the copolymer prepared at 105° C. and 900–950 psig pressure using lauroyl peroxide catalyst or initiator, but has an average of about 10 to 11 such branches if prepared at 150° C. and 900–950 psig and using tert butyl peroxide catalyst or initiator.

The pressures employed can range between 500 and 30,000 psig. However, relatively moderate pressures of 700 to about 3,000 psig will generally suffice with vinyl esters such as vinyl acetate. In the case of esters having a lower reactivity to ethylene, such as methyl methacrylate, then somewhat higher pressures, such as 3,000 to 10,000 psi have been found to give more optimum results than lower pressures. In general, the pressure should be at least sufficient to maintain a liquid phase medium under the reaction conditions, and to maintain the desired concentration of ethylene in solution in the solvent.

The time of reaction will depend upon, and is interrelated to, the temperature of the reaction, the choice of catalyst, and the pressure employed. In general, however, 0.5 to 10, usually 2 to 5 hours will complete the desired reaction.

C. Ether—The preferred ether compounds utilized in the present invention comprise alkylated diphenyl ethers. These ethers may be prepared by alkylating diphenyl ether with dimerized or polymerized $\alpha$-olefins as described in U.S. Pat. No. 3,999,960, the disclosure of which is incorporated herein by reference. The diphenyl ether preferably is alkylated with the dimer of an alpha olefin having 16 to 44 carbon atoms.

The following examples demonstrate the synergistic combination of the amorphous wax, copolymer and ether in improving the cold flow properties of a middle distillate fuel. In these examples, the amorphous normally solid fraction comprised of a 600 Neutral Foots oil, having about 45.6 weight percent paraffins and a molecular weight as determined by vapor phase osmometry of about 540. The copolymer comprised an ethylene vinyl acetate having a number average molecular weight (VPO) of about 1,800, and the ether comprised an alkyl diphenyl ether wherein the alkyl group comprises a dimerized $C_{16}$ alpha olefin.

The additives listed in Table I were added to a wax containing middle distillate fuel having a WAP of −8° C. maintained at about 25° C. A test has been devised which has been found to be a relatively accurate indicator of cold flow performance of fuels in passing through filter media. In this test, designated as Low Temperature Filterability Test (LTFT) the test fuel is cooled at a rate of 1° C./hour to the desired test temperature and subsequently is passed through a screen having openings 17 microns in diameter under a pressure of 6 inches of mercury. The fuel is determined to pass the test if the fuel flow through the screen is completed in 60 seconds or less.

COMPARATIVE EXAMPLE 1

Table I presents a summary of LTFT tests conducted on a fuel having a WAP of −8° C. This fuel failed the LTFT with no additives at −10° C. This fuel also failed the LTFT test at about −13.3° C. when 0.30 weight percent 600 Neutral Foots oils and either 0.15 or 0.18 weight percent ethylene vinyl acetate copolymer were added to the fuel. Similarly, a fuel sample having added thereto 0.30 weight percent 600 Neutral Foots oil and 0.10 alkyl diphenyl ether produced a failure in the LTFT test at −13° C. Another fuel sample having added thereto 0.15 weight percent ethylene-vinyl acetate copolymer and 0.10 alkyl diphenyl ether also failed the LTFT test at −13.3° C.

EXAMPLE 1

By comparison, when all three components were added, i.e., the amorphous wax, copolymer and alkyl diphenyl ether to the previously described fuel sample having a WAP of −8° C., the test fuel passed the LTFT test at temperatures of −14.4° C. and −17.8° C., as shown in Table I.

TABLE I

| 600 Neutral Foots Oil | Ethylene Vinyl Acetate Copolymer | Alkyl diphenyl Ether | LTFT Result at 10° C. | −13.3° C. | −14.4° C. | −15.6° C. | −16.7° C. | −17.8° C. |
|---|---|---|---|---|---|---|---|---|
| — | — | — | Fail | | | | | |
| 0.30 | 0.15 | — | | Fail | | | | |
| 0.30 | 0.18 | — | | Fail | | | | |
| 0.30 | — | 0.10 | | Fail | | | | |
| — | 0.15 | 0.10 | | Fail | | | | |
| 0.30 | 0.06 | 0.025 | | Pass | Pass | | Fail | |
| 0.30 | 0.07 | 0.03 | | | | Pass | | Pass |

COMPARATIVE EXAMPLE 2

A second fuel sample having a WAP of about −7.2° C. was utilized. This fuel failed the LTFT test at about −9° C. with no additives. As shown in Table II, utilizing 600 Neutral Foots oil in combination only with ethylene vinyl acetate copolymer, the fuel failed with LTFT test at −15.6° C. and utilizing 600 Neutral Foots oil in combination only with alkyl diphenyl ether the fuel produced failures in the LTFT test at −14.4° C.

EXAMPLE 2

In contrast, the two fuel samples having a WAP of −7.2° C. and having amorphous wax, copolymer and alkyldiphenyl ether, all present passed the LTFT tests at −16.7° C. and −18.9° C., respectively.

TABLE II

| 600 Neutral Foots Oil | Ethylene Vinyl Acetate Copolymer | Alkyl diphenyl Ether | LTFT Result at 9° C. | −13.3° C. | −14.4° C. | −15.6° C. | −16.7° C. | −17.8° C. | −18.9° C. |
|---|---|---|---|---|---|---|---|---|---|
| — | — | — | Fail | | | | | | |
| 0.30 | 0.12 | — | | Fail | | | | | |
| 0.30 | 0.15 | — | | Pass | Pass | Fail | Fail | | |
| 0.30 | — | 0.10 | | Fail ° | Fail | | | | |
| 0.30 | .056 | 0.024 | | Pass | | Pass | | | |
| 0.30 | .07 | 0.03 | | | | | Pass | Pass | Pass |

Based on the results in Tables I and II, it can be seen that the addition to wax-containing distillate of all three components produced wax crystals which were sufficiently small to permit the fuel to pass through the filter pores at lower temperatures than would be possible using only two of the three components.

The fuel additive of the present invention may have the following composition:

| Additive | Wt. % Range | Preferred Wt. % Range |
|---|---|---|
| Amorphous Wax | 60–90 | 70–80 |
| Ethylene/Ester Copolymer | 15–30 | 15–25 |
| Ether | 5–20 | 5–10 |

Fuel additives conventionally are sold as concentrates in solvent so that they can be easily added to the distillate fuel which is to be treated to improve its cold flow properties. Typically, a diluent is added so that the additive is a single phase liquid. A typical additive concentrate has the following composition.

| Additive | Wt. % Range | Preferred Wt. % Range |
|---|---|---|
| Amorphous Wax | 15–45 | 25–31 |
| Ethylene/Ester Copolymer | 3–10 | 6–8 |
| Ether | 1–5 | 2–4 |
| Diluent | 40–81 | 47–67 |

A preferred diluent is a heavy aromatic naphtha. The additive preferably is added to the fuel at a temperature substantially above the wax appearance point, since the solubility of the additive in the fuel will be higher at elevated temperature.

The concentration of the additives in the distillate fuel preferably are as follows:

| Additive | Preferred Wt. % Range of Distillate Fuel |
|---|---|
| Amorphous Wax | 0.04–1.5 |
| Ethylene/Ester Copolymer | 0.01–0.3 |
| Ether | 0.005–0.15 |

What is claimed is:

1. A wax-containing petroleum distillate fuel having a boiling range within the limits of about 120° C. and about 400° C. which has improved low temperature flow properties by the addition thereto of:

A. between about 0.04 and about 1.5 wt.% of an amorphous, normally solid, essentially saturated hydrocarbon fraction substantially free of normal paraffin hydrocarbons, said fraction having a number average molecular weight of from about 500 to about 3000;

B. between about 0.01 and about 0.3 wt.% of a wax-modifying random copolymer of ethylene and an unsaturated ester, said copolymer comprising from about 3 to about 40 molar proportions of ethylene per molar proportion of other monomers and having a number average molecular weight of from about 1000 to about 50,000 with less than 6 methyl-terminating side branches on the polyethylene backbone per 100 methylene groups of said backbone, and said unsaturated ester having the general formula:

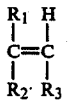

wherein:

(a) $R_1$ is selected from the group consisting of hydrogen and methyl radicals:

(b) $R_2$ is selected from the group consisting of hydrogen and —$OOCR_4$ and $COOR_4$ groups;

(c) $R_3$ is selected from the group consisting of hydrogen and —$COOR_4$; and (d) $R_4$ is selected from the group consisting of hydrogen and $C_1$–$C_{28}$ straight or branched chain alkyl groups; and C. between about 0.005 and about 0.15 wt.% of a diphenyl ether containing a diphenyl ether alkylated with the dimer of an alpha olefin having from 16 to 44 carbon atoms, wherein the concentrations of A, B and C are based on wt.% of said fuel.

2. The composition of claim 1 wherein the number average molecular weight of the copolymer ranges between about 1,000 and about 6,000.

3. The composition of claim 2 wherein the number average molecular weight of the copolymer ranges between about 1,000 and about 3,000.

4. The composition of claim 3 wherein the number average molecular weight of the copolymer ranges between about 1,500 and about 2,500.

5. The composition of claim 1 wherein $R_4$ is selected from the group consisting of hydrogen and $C_1$ to $C_{16}$ straight or branched chain alkyl groups.

6. An additive for improving the low temperature flow properties of a middle distillate fuel, said additive comprising:

(a) about 60 to about 90 weight percent amorphous wax;

(b) about 15 to about 30 weight percent ethylene/unsaturated ester copolymer; and (c) about 5 to about 20 weight percent alkylated diphenyl ether.

7. The additive of claim 6 comprising:

(a) about 70 to about 80 weight percent amorphous wax;

(b) about 15 to about 25 weight percent ethylene/ester copolymer; and (c) about 5 to about 10 weight percent alkylated diphenyl ether.

8. An additive concentrate for improving the low temperature flow properties of a middle distillate fuel, said additive comprising:

(a) about 15 to about 45 weight percent amorphous wax;

(b) about 3 to about 10 weight percent ethylene/ester copolymer;

(c) about 1 to about 5 weight percent alkylated diphenyl ether; and (d) about 40 to about 81 weight percent diluent.

9. The additive concentrate of claim 8 comprising:

(a) about 25 to about 35 weight percent amorphous wax;

(b) about 6 to about 8 weight percent ethylene/ester copolymer;

(c) about 2 to about 4 weight percent alkylated diphenyl ether; and (d) about 47 to about 67 weight percent diluent.

10. The additive concentrate of claim 9 wherein the diluent comprises a heavy aromatic naphtha.

* * * * *